United States Patent [19]

Nystrom et al.

[11] 4,294,438

[45] Oct. 13, 1981

[54] REPLACEABLE LINER FOR A CRUCIBLE

[75] Inventors: William A. Nystrom; Leo C. Lanzel; William A. Bauer, all of St. Marys, Pa.

[73] Assignee: The Stackpole Corporation, St. Marys, Pa.

[21] Appl. No.: 173,735

[22] Filed: Jul. 30, 1980

[51] Int. Cl.[3] ..... B28B 7/08

[52] U.S. Cl. ..... 266/280; 75/95

[58] Field of Search ..... 266/280; 75/95, 65

[56] References Cited

U.S. PATENT DOCUMENTS

| | | | |
|---|---|---|---|
| 3,689,051 | 9/1972 | Miller | 266/280 |
| 4,076,224 | 2/1978 | Duchateau | 266/280 |

*Primary Examiner*—P. D. Rosenberg

*Attorney, Agent, or Firm*—Brown, Flick & Peckham

[57] ABSTRACT

A replaceable liner for a crucible for molten metal consists of an open-top receptacle having at least its side wall made of graphite foil formed earlier by compressing expanded graphite.

6 Claims, 6 Drawing Figures

REPLACEABLE LINER FOR A CRUCIBLE

The molten metal industry uses crucibles into which molten metal is poured. For metals having low enough melting temperatures the crucibles may be made of metal, but for high melting point metals the crucibles are made of graphite. The graphite crucibles are machined from solid graphite blocks or they are molded into the desired shape from clay-bonded materials. Whether the crucibles are metal or graphite, they gradually deteriorate with use so that after a while they need replacement. Replacing the crucibles is expensive and wastes material because the deteriorated crucibles must be discarded. This is particularly undesirable in the case of graphite crucibles.

It is among the objects of this invention to provide a crucible with an inexpensive replaceable graphite liner so that the crucible itself will not deteriorate in use or so that it will at least have a much longer life than heretofore.

The invention is illustrated in the accompanying drawings, in which

Figure 1:
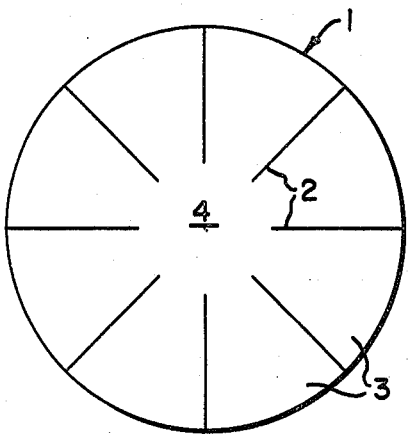
FIG. 1 is a plan view of a flat blank of graphite foil.

The crucible liner disclosed herein is made from graphite foil formed by compressing expanded or vermiform graphite that has been made in a well-known manner, such, for example, as disclosed in patent 3,404,061. The compression may be such that the foil is only 15 to 50 mils thick, with a density between 0.1 and 2.2 g/cc, but preferably between 0.8 and 1.2 g/cc. No binder is required, so the foil consists substantially entirely of graphite. Referring to FIG. 1 of the drawings, a circular blank 1 is cut from a sheet of the graphite foil and the blank is provided with uniformly spaced slits 2 that extend from its edge radially inward a predetermined distance, whereby a plurality of inwardly tapered pie-shape segments 3 are formed. The inner ends of the slits terminate around a central area 4 that will form the bottom of the liner.

Figure 2:
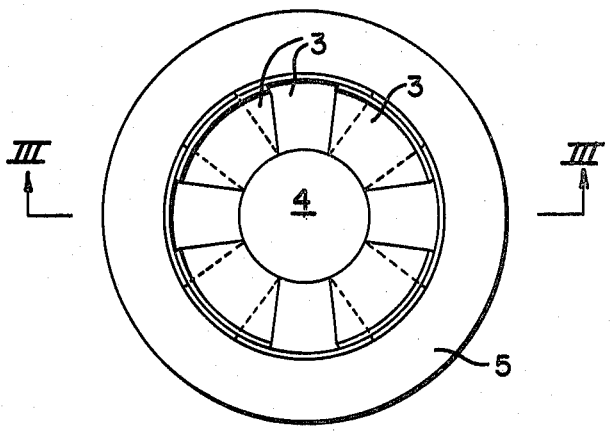
FIG. 2 is a plan view of the blank shaped into a receptacle and forming the lining for a crucible.
Figure 3:
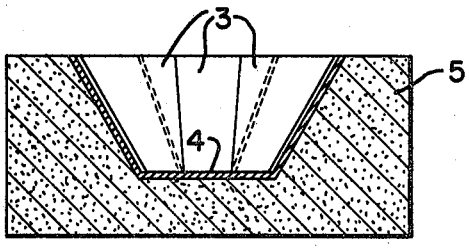
FIG. 3 is a vertical section taken on the line III—III of FIG. 2.

The tapered segments of the blank then are folded up with their side edges overlapping one another as shown in FIGS. 2 and 3, and the unit is placed in a die cavity (not shown) where it is pressed and shaped to form an open-top receptacle with an inclined side wall. The die cavity has the shape that the receptacle is to take in order to fit in the desired crucible 5 and form a lining for it. The die pressure is such as to increase the density of the graphite foil to between 0.1 and 2.2 g/cc, preferably between 1.1 and 1.9 g/cc. The overlapping edges of the tapered segments are pressed tightly together so that the foil receptacle will hold its shape when it is removed from the die, ready to be placed in crucible 5, the interior of which has the same size and shape as the foil receptacle.

If a liner is desired that is thicker than will be formed by a single blank of graphite foil, two or more of the foil blanks can be stacked on top of one another before pressing in a die, whereby the thickness of the liner will be increased to the desired extent.

Figure 5:
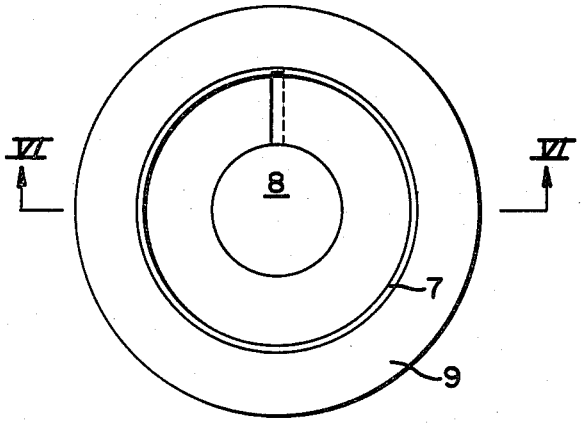
FIG. 5 is a plan view of the blank lining the inner side wall of a crucible.
Figure 6:
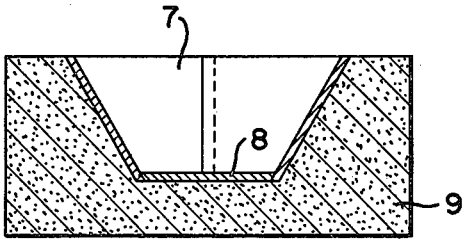
FIG. 6 is a vertical section taken on the line VI—VI of FIG. 5.
Figure 4:
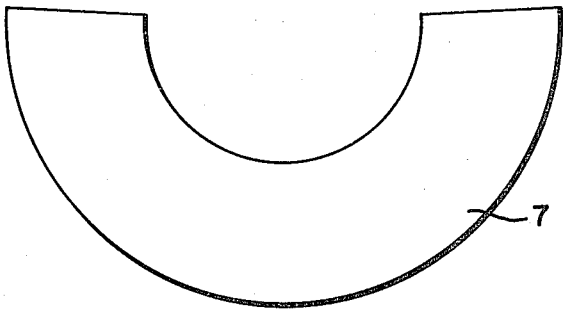
FIG. 4 is a plan view of a blank of graphite foil according to a modification.

Another way of making the crucible liner is illustrated in FIGS. 4, 5 and 6. As shown in FIG. 4, a strip 7 of graphite foil, curved from end to end, is cut from a foil sheet. It is of such length that it can be wrapped completely around the side wall of a die cavity (not shown), with the ends of the strip overlapping slightly. A circular disc 8 (FIG. 5) of graphite foil, or of a graphite foil preform having a density between 0.05 and 0.4 g/cc, is placed in the bottom of the die. This assembly of side wall strip and bottom disc then is pressed to final thickness and density to form a liner for a crucible 9 as shown in FIGS. 5 and 6. The die pressure will also cause the side and bottom walls of the liner to join together.

Instead of placing a disc of foil or foil preform in the bottom of the die, a layer of expanded graphite flakes or chopped up graphite foil or chopped up graphite preform may be placed in the bottom of the die. This layer is then pressed to a density between 0.1 and 2.2 g/cc, preferably to 1.1 to 1.9 g/cc, to form the liner bottom that will adhere to the strip forming the side wall of the liner.

With the use of a crucible liner such as described herein, the crucible is protected by the graphite liner from deteriorating. When the liner itself becomes unsuitable for further use, it is quickly replaced by a similar graphite liner. Since the discarded liner is composed of such a small amount of graphite, there is no great loss in discarding it as compared with discarding an entire crucible.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. A replaceable liner for a crucible for molten metal, the liner consisting of an open-top receptacle having at least its side wall made of graphite foil preformed from compressed expanded graphite.

2. A replaceable liner according to claim 1, in which the entire receptacle is made of said foil.

3. A replaceable liner according to claim 2, in which the side wall of said receptacle is in the form of laterally overlapping pie-shape segments tapering downwardly and integrally joined at their lower ends to a circular bottom wall, and the overlapping areas of said segments are compressed tightly together.

4. A replaceable liner according to claim 1, in which only said side wall is graphite foil, and the bottom wall is formed from compressed expanded graphite.

5. A replaceable liner according to claim 1, in which said side wall is a circular strip of graphite foil with overlapping ends compressed together, and the bottom wall is formed from compressed expanded graphite joined to the lower edge of said strip.

6. The method of making a replaceable liner for a crucible for molten metal, comprising providing a circular graphite foil blank formed from compressed expanded graphite with a plurality of circumferentially spaced slits extending from the edge of the disc radially inwardly a predetermined distance to form inwardly tapered pie-shape segments around a solid central circular area, centering the disc over a die cavity shaped like the desired liner, and pressing the disc down into the cavity to form a liner having a side wall formed from the laterally overlapping segments extending upwardly from a circular bottom wall.

* * * * *